US006135413A

United States Patent [19]

Glebe

[11] Patent Number: 6,135,413

[45] Date of Patent: Oct. 24, 2000

[54] REAR LEG SUPPORT FOR EASEL OR THE LIKE

[76] Inventor: Gregory N. Glebe, 351 Linden St., Ft. Collins, Colo. 80524

[21] Appl. No.: 09/193,467

[22] Filed: Nov. 17, 1998

[51] Int. Cl.[7] ..... A47B 19/00

[52] U.S. Cl. ..... 248/441.1; 248/457; 248/465.1; 248/431

[58] Field of Search ..... 248/441.1, 447, 248/447.2, 455, 456, 457, 463, 465, 465.1, 163.1, 168, 437

[56] References Cited

U.S. PATENT DOCUMENTS

| | | | |
|---|---|---|---|
| 191,577 | 6/1877 | Fisher . | |
| 294,941 | 3/1884 | Werner . | |
| 526,907 | 10/1894 | Lurssen et al. . | |
| 550,322 | 11/1895 | Holman . | |
| 733,860 | 7/1903 | Mendel | 248/456 |
| 855,743 | 6/1907 | Anthony . | |
| 1,251,006 | 12/1917 | Freundt . | |
| 3,141,260 | 7/1964 | Dompieri | 248/455 |
| 3,171,687 | 3/1965 | Jensen | 248/456 |
| 3,376,009 | 4/1968 | Domino | 248/456 |
| 3,623,691 | 11/1971 | Albee, Jr. . | |
| 4,002,240 | 1/1977 | Dorn | 211/42 |
| 4,467,727 | 8/1984 | Strommer | 108/23 |
| 4,618,119 | 10/1986 | Powell | 248/456 |
| 5,582,382 | 12/1996 | Pan-Yang | 248/456 |

FOREIGN PATENT DOCUMENTS

| | | | |
|---|---|---|---|
| 0000597 | 1/1909 | United Kingdom | 248/441 C |
| 332830 | 7/1930 | United Kingdom | 248/463 |
| 1568970 | 6/1980 | United Kingdom . | |

*Primary Examiner*—Ramon O. Ramirez
*Assistant Examiner*—Walter Landry
*Attorney, Agent, or Firm*—Synnestvedt & Lechner LLP

[57] ABSTRACT

A tripod easel support device comprising a pair of relatively inwardly inclining bracing elements each joined together at one end at an apex, the apex including a leg-receiving recessed portion conforming to the rear leg profile to receive the rear leg of a tripod easel and further having a pair of inwardly projecting detent surfaces formed to project inwardly of the side surfaces of the rear leg to retain the leg within the recess. The rigid bracing elements are provided with end projections at the ends opposite to the recessed portion for pivotally mounting the device in pre-drilled openings in the side edges of the front legs. The recessed portion slopes downwardly relatively to the bracing elements. When the rear leg is extended, the leg is locked in position between the detent surfaces and the rear wall surface of the recess. For storage, the device is pivoted upwardly and the rear leg moves flush with the front legs. In the upper position of the device, the rear leg is again clamped in position and releasably locked against movement.

4 Claims, 2 Drawing Sheets

REAR LEG SUPPORT FOR EASEL OR THE LIKE

FIELD OF THE INVENTION

This invention relates to easels and like devices, especially tripod easels and stabilizing devices for a rear leg of such easels.

BACKGROUND OF THE INVENTION

Easels of the tripod style have been available for many years for use in displaying works of art, charts, posters and the like, as well as serving as working easels for artists. All such easels are of the same basic design, having legs joined at the top with a rear leg hingedly mounted relative to the others so that it can be shifted between a retracted position adjacent to the plane of the other two legs and an angularly extended position in which the three legs form a triangular support for the art work. In this type of easel, the two front legs are generally joined by a tray which supports the art work while the third leg is relatively movable from the retracted or storage position to the extended position for use.

A major draw back of this design is that the rear leg is attached only at the top, and this arrangement allows for a great deal of motion that compromises the stability of the easel. For example, pushing the easel backwards may cause the rear leg to fold inwardly causing a collapse. In addition, the weight of the art work or downward pressure may cause the rear leg to slide backwards, also resulting in collapse. To counteract this, most easels have a chain or chains attached to the rear leg and the front tray to prevent the rear leg from sliding back too far. This still leaves the easel unstable with the rear leg vulnerable to lateral movement or, if the easel is pushed, to movement toward the front legs. It also makes the easel, which is meant to be portable, awkward to move since the rear leg will swing around during transport.

Various ways of stabilizing the rear leg have been adopted in the past. Known means involve use of rigid metal braces which permanently lock the legs in place. Sometimes metal braces hinged in the middle and being lockable in the straight position to fix the legs in position have been employed. Relatively slidable pieces fixed to the legs are provided with fasteners which allow for interlocking the pieces in a plurality of positions to selectively lock the legs in the extended or retracted positions. Each of the known alternatives is relatively expensive, and as a result, none of them have been widely adopted. As a result, a long-felt need has persisted for a universally acceptable stabilizing device which is simple to manufacture, made from readily available and standard materials and which can be fit to almost any tripod easel. Such a device should be inexpensive and easy for the average consumer to install on previously purchased easels.

SUMMARY AND OBJECTS OF THE INVENTION

In summary, the invention provides a support device for the rear leg of a tripod easel comprising a pair of rearwardly extending relatively rigid support braces each having a first end portion adapted to be pivotally mounted on one of the pair of front legs of the easel. The support braces have second end portions disposed rearwardly of the first end portions and extend angularly towards an apex. At the apex, a rear leg engaging receptacle portion interconnects the two support braces to form a relatively simple and rigid frame. The receptacle portion is configured to receive and fit around the sides and rear surface of the rear leg and is preferably provided with detent means in the form of projections which inwardly extend adjacent the front surface of the leg. Alternative detent means may be utilized such as an elastic O-ring fitted around the braces adjacent the receptacle, a wire clip or an elastomeric band. Preferably, the receptacle portion projects angularly downwardly relative to the plane of the support braces. The receptacle allows for limited movement of the rear leg between the collapsed position and the support position. When in the support position, the rear leg is locked against relative movement with respect to the front legs. In a preferred form, the support device consists of a single, relatively rigid wire form which includes pivotal support projections, the support braces and the receptacle portion including the detent means.

An important object of the invention is the provision of a leg support for the rear leg of an easel or similar device of the tripod type which is universally adaptable to most tripod easel designs.

A further objective of the invention is the provision of a stabilizing support for the rear leg of a tripod easel which prevents substantial movement of the rear leg relative to the others in any direction.

A still further objective is the provision of a leg support which immobilizes the rear leg in the folded position to facilitate easy transport.

Other objectives of the invention are the provision of a leg support for a tripod easel which can be manufactured from inexpensive materials which the resulting low cost to the consumer and which is easy to install.

DETAILED DESCRIPTION OF THE PREFERRED EMBODIMENT OF THE INVENTION

Figure 1:
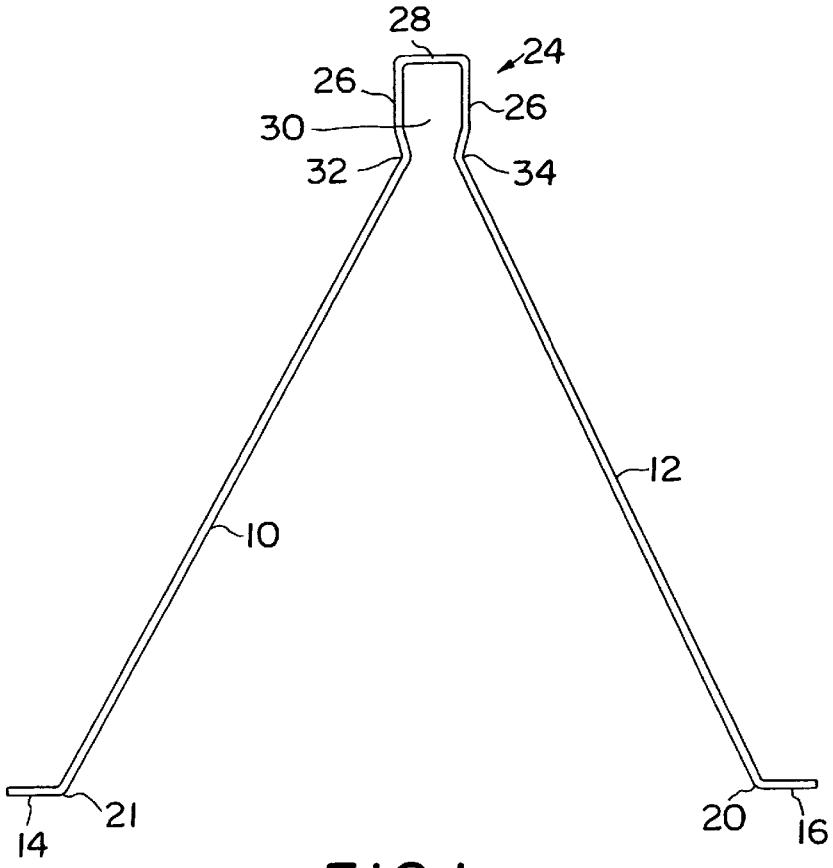
FIG. 1 hows a top view of a presently preferred form of an easel rear leg support device incorporating the principles of the invention.
Figure 3:
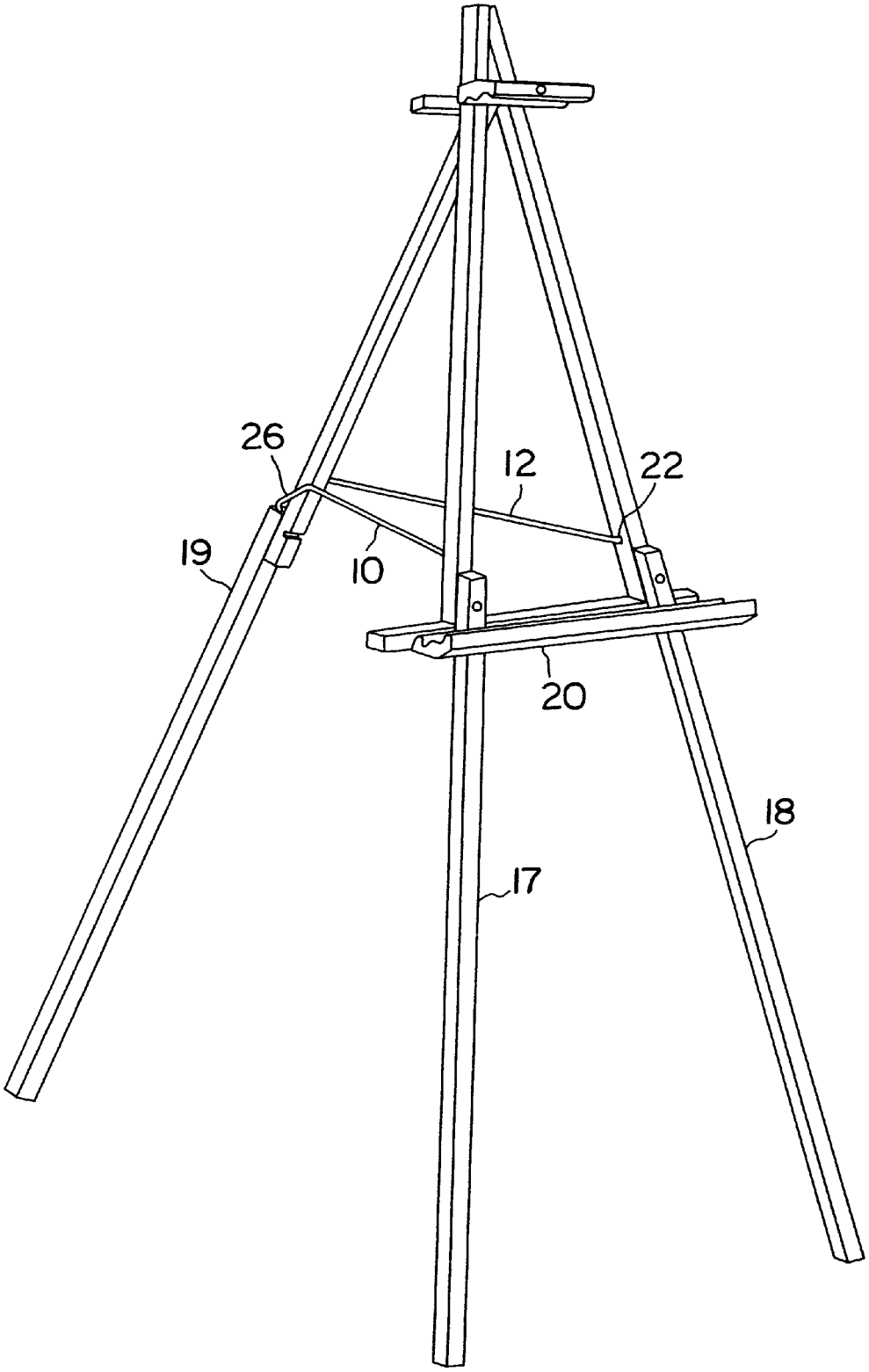
FIG. 3 is a perspective view of an easel demonstrating the use of the support device of FIGS. 1 and 2.

With reference first to FIG. 1, a support device of the presently preferred form of the invention comprises a unitary wire form which consists of substantially straight bracing portions 10 and 12 each having first end portions 14 and 16 which are bent as at 20 and 21 so to project laterally outwardly, thereby forming pivotal supports which fit within recesses in the side portions of the front legs. One such recess 22 is illustrated in the easel of FIG. 3. In FIG. 3, it can be seen that the easel comprises front legs 17 and 18 and a rear leg 19 pivotally mounted to the front legs. A work support 20 is attached to each of the front legs and locks these legs in position with respect to one another. The recesses 22 may be provided for the purpose at the factory or may be drilled into the side edges of the legs by the user of the easel in cases where the user may wish to modify a previously purchased easel.

As can be seen upon further reference to FIG. 1, support brace portions 10 and 12 extend angularly inwardly relative to one another to a receptacle portion generally indicated at 24. The receptacle portion 24 is generally U-shaped having side portions 26 and rear wall portion 28, thereby defining a cavity or receptacle 30 within which the rear leg is slidably received. To ensure that the rear leg is retained within the cavity 30, the end portions of the support braces are preferably bent inwardly as shown at 32 and 34. The inwardly bent portions project inwardly of the front edge of the rear leg and serve as a detent means retaining the rear leg in position within the cavity, unless it is desired to deliberately move it out of the cavity.

Preferably, the support device including the receptacle and the detent portions is fabricated from a single piece of wire or similar material possessing sufficient ductility to allow it to be bent into the shape illustrated, sufficient stiffness to retain the pre-bent shape and serve a bracing function and a degree of resilience sufficient to urge the end portions 14 and 16 into the recesses formed in the front legs and to resiliently retain the rear leg within the cavity 30 in receptacle 24.

Other forms of detent means may be provided if desired. For example, a resilient O-ring, an elastic band or wire clip may be fitted over the receptacle portion for use in place of detent projections 32 and 34.

Figure 2:
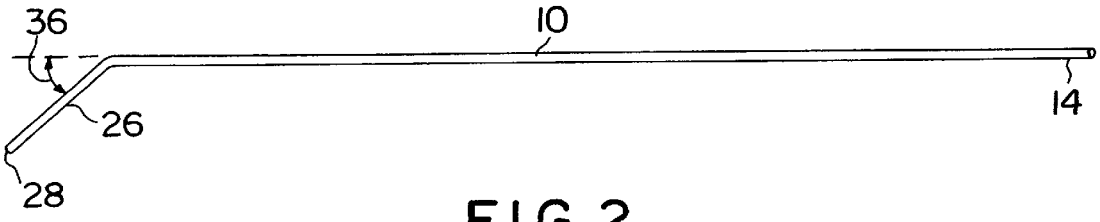
FIG. 2 is a side view of the support device of FIG. 1.

As indicated above, the receptacle portion 24 is preferably downwardly sloped at an acute angle with respect to the support braces 10 and 12, as can be seen in FIG. 2 and indicated by the reference character 36. The downward slope 36 operates to position the detent portions 32 and 34 and the back wall 28 in clamping interengagement with the rear leg when the rear leg is in the fully extended position. The side edges of the receptacle, as illustrated at 26, in conjunction with the detent portions 32 and 34 and the back 28 in conjunction with the slope of the receptacle determine the point at which the receptacle grips the rear leg. Since the sides 26 are longer than the depth of the rear leg, vertical movement of the support device is allowed between the lowered position in which the rear leg is locked in its extended position and the raised position in which the rear leg is in its collapsed position for storage or transport.

Preferably, the support braces 10 and 12 diverge from the receptacle portion at an angle which is large enough relatively to the spacing of the front legs to cause the support brace end portions 14 and 16 to be resilient urged into the openings in the easel front legs. The braces can be squeezed by the hands of the user sufficiently to permit the end portions to be inserted into the openings, after which release of the pressure resiliently retains them in position.

Through use of the invention, the easel becomes a stable platform upon which to display items or to work. The rear leg can be readily collapsed so that it lays flush with the front two legs merely by lifting the support device and moving it to the raised position. This action tends to restrict movement of the rear leg when collapsed discouraging it from swinging freely when the easel is moved. To lock the rear leg in the extended position, the support device is pivoted downwardly so that the receptacle slides relatively to the leg until the leg is clamped between the rear surface of the receptacle and the detents 32 and 34. It should be evident that the device can be simply manufactured from inexpensive and readily available material. The entire device may be fabricated of a single piece of relatively stiff wire and can be easily attached to the easel by the end user.

What is claimed is:

1. A tripod easel comprising:

a pair of front legs;

a rear leg hingedly jointed to the front legs at the upper end thereof and being movable from a collapsed position adjacent to the plane of the front legs and a support position disposed rearwardly of said front legs;

a support device for the rear leg comprising a pair of rearwardly extending support braces, each brace having a first end pivotally mounted on one of said pair of front legs at pivot locations equidistantly spaced from the upper ends of said front legs;

said support braces having second end portions disposed rearwardly of said first end portions;

a rear leg receiving receptacle portion interconnecting the second ends of each of said support braces, the receptacle portion having side wall portions extending adjacent opposite sides of said rear leg and a rear wall extending along the back side of said rear leg; and further including detent means extending inwardly from said side walls for retaining said rear leg within said receptacle portion;

said receptacle portion being dimensioned to allow for limited sliding movement of said rear leg between said collapsed position and said support position, said leg being clamped between said rear wall and said detent means when the rear leg is moved to said support position.

2. A support device according to claim 1, wherein the receptacle portion extends angularly downwardly relatively to said rearwardly extending support braces.

3. A support device according to claim 2, wherein the device comprises a single relaitvely rigid wire form including said support braces and said receptacle portion.

4. A support device according to claim 3, wherein said pivotal mounting means comprises outwardly extending bends on said end portions of said support braces, said outwardly extending bends being received in pre-drilled cavities in said front legs.

* * * * *